US011761348B2

(12) United States Patent
Iwai et al.

(10) Patent No.: US 11,761,348 B2
(45) Date of Patent: Sep. 19, 2023

(54) AXIAL FLOW TURBINE WITH UPSTREAM GLAND AND EXTRACTION OF COOLING AIR

(71) Applicant: TOSHIBA ENERGY SYSTEMS & SOLUTIONS CORPORATION, Kawasaki (JP)

(72) Inventors: Shogo Iwai, Ota Tokyo (JP); Tsuguhisa Tashima, Yokohama Kanagawa (JP); Takahiro Ono, Ota Tokyo (JP); Daisuke Nomura, Kawasaki Kanagawa (JP)

(73) Assignee: TOSHIBA ENERGY SYSTEMS & SOLUTIONS CORPORATION, Kawasaki (JP)

( * ) Notice: Subject to any disclaimer, the term of this patent is extended or adjusted under 35 U.S.C. 154(b) by 9 days.

(21) Appl. No.: 17/174,682

(22) Filed: Feb. 12, 2021

(65) Prior Publication Data

US 2021/0262362 A1 Aug. 26, 2021

(30) Foreign Application Priority Data

Feb. 20, 2020 (JP) ..... 2020-027329

(51) Int. Cl.
*F01D 25/14* (2006.01)
*F01D 11/24* (2006.01)
*F01D 25/12* (2006.01)

(52) U.S. Cl.
CPC ..... *F01D 25/14* (2013.01); *F01D 11/24* (2013.01); *F01D 25/12* (2013.01); *F05D 2220/31* (2013.01); *F05D 2220/32* (2013.01); *F05D 2240/55* (2013.01); *F05D 2260/20* (2013.01)

(58) Field of Classification Search
CPC ..... F01D 25/12; F01D 25/14; F01D 9/065
See application file for complete search history.

(56) References Cited

U.S. PATENT DOCUMENTS

| | | | | |
|---|---|---|---|---|
| 2,823,891 | A | 2/1958 | Baker et al. | |
| 10,787,907 | B2 * | 9/2020 | Tsuruta | F01D 3/04 |
| 2014/0023478 | A1 | 1/2014 | Maeda | |

(Continued)

FOREIGN PATENT DOCUMENTS

| | | | |
|---|---|---|---|
| DE | 11 2018 000 772 | T5 | 11/2019 |
| EP | 1 502 966 | A2 | 2/2005 |
| JP | S59-039902 | A | 3/1984 |

(Continued)

*Primary Examiner* — Courtney D Heinle
*Assistant Examiner* — John S Hunter, Jr.
(74) *Attorney, Agent, or Firm* — Foley & Lardner LLP

(57) ABSTRACT

There is provided an axial flow turbine capable of realizing a reduction in gland leakage amount. The axial flow turbine in an embodiment is of a single flow type and includes an upstream-side gland part located on an upstream side of a working medium in an axial direction of a turbine rotor and a downstream-side gland part located on a downstream side of the working medium in the axial direction of the turbine rotor. The axial flow turbine is configured such that a cooling medium lower in temperature and higher in pressure than the working medium is extracted in a middle of flowing from the inside to the outside of the turbine casing in the upstream-side gland part, and the extracted cooling medium is introduced into the stationary blade.

5 Claims, 7 Drawing Sheets

(56) References Cited

U.S. PATENT DOCUMENTS

| | | | | |
|---|---|---|---|---|
| 2019/0323351 | A1 | 10/2019 | Tsuruta et al. | |
| 2020/0072068 | A1 * | 3/2020 | Takata | F01D 9/04 |

FOREIGN PATENT DOCUMENTS

| | | | | |
|---|---|---|---|---|
| JP | 2006-104951 | A | | 4/2006 |
| JP | 2013-050054 | A | | 3/2013 |
| JP | 2013050054 | A | * | 3/2013 |
| JP | 5917324 | B2 | | 5/2016 |

* cited by examiner

AXIAL FLOW TURBINE WITH UPSTREAM GLAND AND EXTRACTION OF COOLING AIR

CROSS REFERENCE TO RELATED APPLICATIONS

This application is based upon and claims the benefit of priority from Japanese Patent Application (JP No. 2020-027329), filed on Feb. 20, 2020; the entire contents of which are incorporated herein by reference.

FIELD

Embodiments described herein relate generally to a single flow type axial flow turbine.

BACKGROUND

A single flow type axial flow turbine is configured such that a working medium flows to one side along an axial direction of a turbine rotor. The single flow type axial flow turbine has an upstream-side gland part located at an end portion on the upstream side and a downstream-side gland part located on an end portion on the downstream-side end in a flow direction of the working medium, and the gland leakage amount is generally larger in the upstream-side gland part than in the downstream-side gland part. When a gland leakage occurs, the flow rate of the working medium working at a turbine stage decreases to degrade the turbine efficiency in some cases.

In particular, as the pressure of the working medium to be introduced into an inlet of the axial flow turbine is higher, the pressure difference between the inside of the axial flow turbine and the outside (atmospheric pressure) is larger, so that the gland leakage amount increases. Therefore, the above problem is more likely to occur in the case where the axial flow turbine is a steam turbine or a $CO_2$ turbine than in the case where the axial flow turbine is a standard gas turbine.

One example of a single flow type axial flow turbine 12J according to a related art will be explained using FIG. 7. FIG. 7 schematically illustrates a partial cross-section (mainly, an upper half cross-section) of a vertical plane (xz plane) defined by a vertical direction z and a first horizontal direction x.

In the axial flow turbine 12J according to the related art, a working medium F is introduced into an inner casing 31 housed in an outer casing 32 in a turbine casing 30 via a transition piece 311. Then, the introduced working medium F works in sequence in a plurality of turbine stages 40 arranged side by side from an upstream side Us to a downstream side Ds. The working medium F is thereafter exhausted to the outside of the turbine casing 30 via an exhaust pipe (not illustrated). Further, in the axial flow turbine 12J, a cooling medium CF is introduced into the turbine casing 30 from the outside via a cooling medium introduction pipe 313.

The axial flow turbine 12J is, for example, a $CO_2$ turbine, and the working medium F is, for example, a supercritical medium containing a combustion gas generated by combustion in a combustor. The cooling medium CF is, for example, a medium which has been subjected to cooling or the like after exhausted from the axial flow turbine 12J, and is introduced into the axial flow turbine 12J in a state where it is lower in temperature than the working medium F and higher in pressure than the working medium F.

As illustrated by arrows of broken lines in FIG. 7, the cooling medium CF is introduced into a cooling chamber R31*a* provided in the inner casing 31, via a clearance between the outer peripheral surface of the transition piece 311 and the inner peripheral surface of the cooling medium introduction pipe 313.

The cooling medium CF introduced into the cooling chamber R31*a* flows into an inner casing cooling medium flow path H31 formed in the inner casing 31. Here, the inner casing cooling medium flow path H31 includes a first inner casing cooling medium flow path part H311 and a second inner casing cooling medium flow path part H312. The first inner casing cooling medium flow path part H311 is a hole along the axial direction of the turbine rotor 20, and has one end located on the upstream side Us of the working medium F, the one end being communicated with the cooling chamber R31*a*. The second inner casing cooling medium flow path part H312 is a hole along the radial direction of the turbine rotor 20 and is provided to supply the cooling medium CF from the first inner casing cooling medium flow path part H311 to the stationary blade 41. The cooling medium CF is supplied to the stationary blade 41 in each of the plurality of turbine stages 40. Then, the cooling medium CF which has been used for cooling the stationary blade 41 is exhausted to, for example, a main flow path through which the working medium F flows inside the inner casing 31.

Further, the cooling medium CF introduced into the cooling chamber R31*a* is introduced into a rotor cooling flow path H21 formed in the turbine rotor 20. Here, the rotor cooling flow path H21 includes a first rotor cooling flow path part H211, a second rotor cooling flow path part H212, and a third rotor cooling flow path part H213, and the cooling medium CF flows through the parts in sequence. The cooling medium CF then flows into a space located between the inner peripheral surface of a heat insulating plate 71 constituting a heat insulating piece 70 and the outer peripheral surface of the turbine rotor 20. The cooling medium CF passes through, for example, a clearance between an implanted part 422 of a rotor blade 42 and the rotor wheel 21 and is then introduced into the rotor blade 42. Thus, the turbine rotor 20 and the rotor blade 42 are cooled. The cooling medium CF introduced into the rotor blade 42 is exhausted, for example, to the main flow path through which the working medium F flows inside the inner casing 31.

In the final-stage turbine stage 40, the cooling medium CF flowing into the space located between the inner peripheral surface of the heat insulating plate 71 and the outer peripheral surface of the turbine rotor 20 is introduced into the rotor blade 42 and additionally flows to a final-stage wheel space RW located on the downstream side Ds from the final-stage rotor wheel 21 in the axial direction. The cooling medium CF flowing to the final-stage wheel space RW leaks from the inside to the outside of the turbine casing 30 in the downstream-side gland part G2. Specifically, in the downstream-side gland part G2, the cooling medium CF flows between the inner peripheral surface of a packing head 321 where a gland sealing part 35*c* is provided and the outer peripheral surface of the turbine rotor 20.

In addition to the above, the cooling medium CF introduced into the cooling chamber R31*a* leaks from the inside to the outside of the turbine casing 30 in the upstream-side gland part G1. Specifically, in the upstream-side gland part G1, the cooling medium CF flows from the cooling chamber R31*a* to a clearance between the inner peripheral surface of the inner casing 31 where a gland sealing part 35*b* is provided and the outer peripheral surface of the turbine rotor 20. Thereafter, the cooling medium CF flows between the inner peripheral surface of the outer casing 32 where a gland sealing part 35*a* is provided and the outer peripheral surface of the turbine rotor 20.

The problem of the above axial flow turbine 12J will be explained.

In the above single flow type axial flow turbine 12J, the gland leakage amount of the cooling medium CF between the rotary body and the stationary body is larger in the upstream-side gland part G1 than in the downstream-side gland part G2 as explained above.

Further, part of the cooling medium CF is introduced from the cooling chamber R31*a* into the inner casing cooling medium flow path H31. Thus, the cooling medium CF flowing to the inlet portion of the upstream-side gland part G1 decreases in flow rate and decreases also in pressure loss correspondingly to the part of the cooling medium CF flowing into the inner casing cooling medium flow path H31. Accompanying this, the gland leakage amount of the cooling medium CF flowing from the inside to the outside of the turbine casing 30 increases in the upstream-side gland part G1.

The cooling medium CF is extracted from the working medium after being exhausted from the axial flow turbine 12J, so that when gland leakage of the cooling medium CF occurs, the flow rate of the working medium F decreases, resulting in a decrease in turbine efficiency.

In particular, as the pressure of the working medium F introduced into the inlet of the axial flow turbine 12J is higher, the pressure of the cooling medium CF needs to be made higher, and therefore the pressure difference between the inside and the outside (atmospheric pressure) increases, so that the gland leakage amount increases. Therefore, in the case where the working medium F and the cooling medium CF are supercritical media as in the axial flow turbine 12J, the above problem is likely to occur. For reduction in the gland leakage amount, it is considered to increase the number of installed gland sealing parts 35*a*, 35*b*, decrease the gap between the rotary body and the stationary body and so on.

However, in the case where the pressure is high as in the above axial flow turbine 12J, the safety with respect to the whirl vibration degrades due to a destabilizing force of the medium flowing through the sealing part. Therefore, in the case where the span between bearings is increased in order to increase the number of installed gland sealing parts 35*a*, 35*b*, the stability of the axis decreases. Besides, in the case where the gap between the rotary body and the stationary body is decreased, contact between the rotary body and the stationary body is likely to occur, thus increasing the possibility of the occurrence of breakage of a member such as a seal fin.

From the above circumstances, it is difficult to decrease the gland leakage amount in the upstream-side gland part G1 in the single flow type axial flow turbine 12J according to the related art, and therefore it is not easy to improve the turbine efficiency.

Accordingly, a problem to be solved by the present invention is to provide an axial flow turbine capable of easily realizing the reduction in gland leakage amount.

DETAILED DESCRIPTION

An axial flow turbine in an embodiment includes: a turbine rotor; a turbine casing housing the turbine rotor; and a turbine stage including a stationary blade cascade in which a plurality of stationary blades are arranged inside the turbine casing, and a rotor blade cascade in which a plurality of rotor blades are arranged on the turbine rotor inside the turbine casing, in which a working medium is introduced into the turbine casing and flows in an axial direction of the turbine rotor to rotate the turbine rotor. The axial flow turbine is of a single flow type and includes: an upstream-side gland part located on an upstream side of the working medium in the axial direction of the turbine rotor; and a downstream-side gland part located on a downstream side of the working medium in the axial direction of the turbine rotor. The axial flow turbine is configured such that a cooling medium lower in temperature and higher in pressure than the working medium is extracted in a middle of flowing from the inside to the outside of the turbine casing in the upstream-side gland part, and the extracted cooling medium is introduced into the stationary blade.

First Embodiment

[Configuration]

Figure 1:
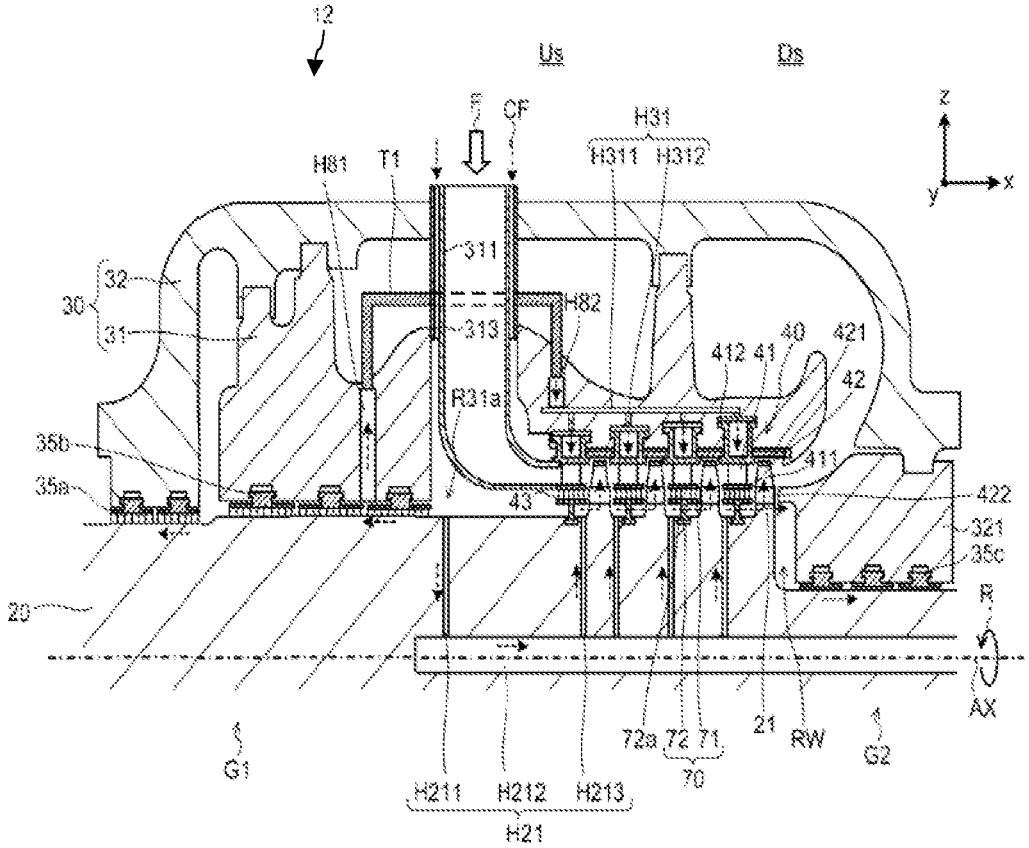
FIG. 1 is a cross-sectional view schematically illustrating a portion of a single flow type axial flow turbine according to a first embodiment.
Figure 7:
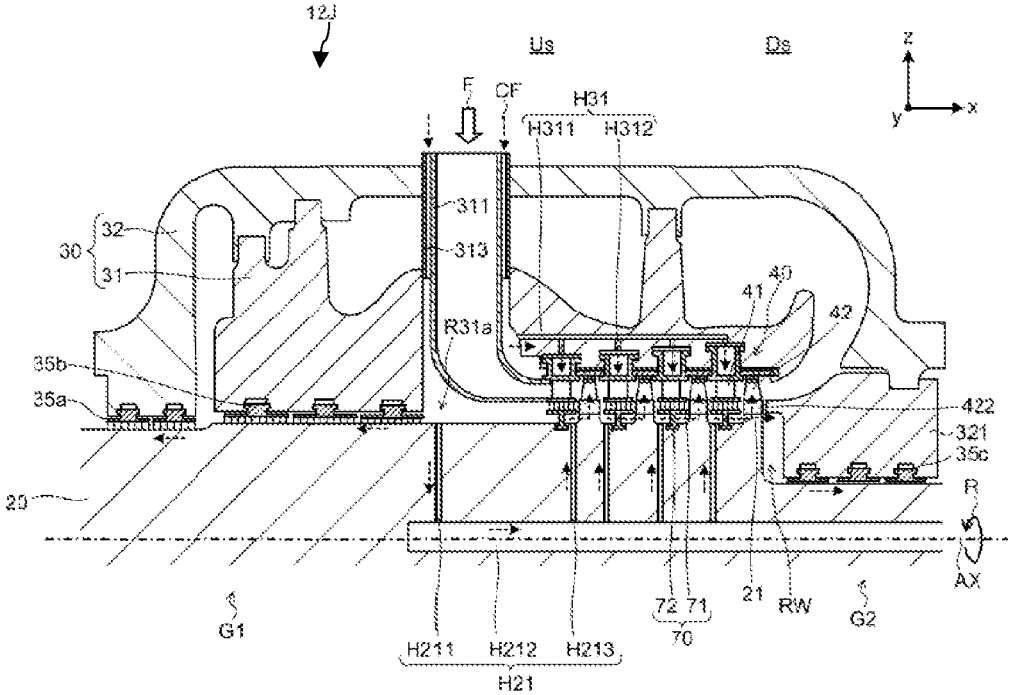
FIG.7 PRIOR ART
FIG. 7 is a cross-sectional view schematically illustrating a portion of a single flow type axial flow turbine according to a related art.

A single flow type axial flow turbine 12 according to a first embodiment will be explained using FIG. 1. FIG. 1 schematically illustrates a partial cross-section of a vertical plane (xz plane) defined by a vertical direction z and a first horizontal direction x as with FIG. 7.

The axial flow turbine 12 according to this embodiment includes, as illustrated in FIG. 1, a turbine rotor 20, a turbine casing 30, and a turbine stage 40. The axial flow turbine 12 is of a multistage type, in which a plurality of turbine stages 40 are arranged side by side in an axial direction (x) along a rotation center axis AX of the turbine rotor 20. In the axial flow turbine 12, a working medium F is introduced to the inside of the turbine casing 30 via a transition piece 311, and works sequentially in the plurality of turbine stages 40 arranged side by side from an upstream side Us to a downstream side Ds. The working medium F is thereafter exhausted to the outside of the turbine casing 30 via an exhaust pipe (not illustrated). Further, the axial flow turbine 12 is configured such that a cooling medium CF is introduced to the inside of the turbine casing 30 from the outside via a cooling medium introduction pipe 313.

The axial flow turbine 12 in this embodiment is, for example, a $CO_2$ turbine as in the case of the related art, and the working medium F is, for example, a supercritical medium containing a combustion gas generated by combustion in a combustor. The cooling medium CF is, for example, a medium which has been subjected to cooling or the like after exhausted from the axial flow turbine 12, and is introduced into the axial flow turbine 12 in a state where it is lower in temperature than the working medium F and higher in pressure than the working medium F.

Details of parts constituting the axial flow turbine 12 according to this embodiment will be explained in sequence.

The turbine rotor 20 is a rod-shaped body, and is supported to be rotatable by a bearing (not illustrated) so that the rotation center axis AX is along the first horizontal direction x. At the turbine rotor 20, a plurality of rotor wheels 21 are provided on the outer peripheral surface. The plurality of rotor wheels 21 are arrayed side by side in the axial direction (x) along the rotation center axis AX. Though not illustrated in FIG. 1, the turbine rotor 20 is coupled to a power generator.

The turbine casing 30 has a double-casing structure including an inner casing 31 and an outer casing 32.

In the turbine casing 30, the inner casing 31 is installed around the turbine rotor in a manner to surround the plurality of turbine stages 40.

In the turbine casing 30, the outer casing 32 is configured to house the turbine rotor 20 via the inner casing 31.

Further, in the outer casing 32, a packing head 321 is installed on the downstream side Ds from the final-stage turbine stage 40 and at an inner portion in a radial direction. Here, a final-stage wheel space RW intervenes between the packing head 321 and a final-stage rotor wheel 21 in the axial direction.

The turbine stage 40 includes a stationary blade cascade composed of a plurality of stationary blades 41 (nozzle blades), and a rotor blade cascade composed of a plurality of rotor blades 42. The turbine stage 40 is composed of the stationary blade cascade and the rotor blade cascade adjacent to the stationary blade cascade on the downstream side Ds, and the plurality of turbine stages 40 are arranged side by side in the axial direction along the rotation center axis AX.

The plurality of stationary blades 41 (nozzle blades) constituting the stationary blade cascade are provided inside the inner casing 31. The plurality of stationary blades 41 are arrayed in a rotation direction R in a manner to surround the turbine rotor 20 between an inner shroud 411 and an outer shroud 412.

The plurality of rotor blades 42 constituting the rotor blade cascade are arrayed in the rotation direction R in a manner to surround the turbine rotor 20 inside the inner casing 31. In the rotor blade 42, an implanted part 422 is provided at an inner portion in the radial direction. The implanted part 422 is fitted on the outer peripheral surface of the rotor wheel 21 of the turbine rotor 20. The outer periphery of the rotor blade 42 is surrounded by the shroud segment 421. The shroud segment 421 is supported by the outer shroud 412.

At a portion facing the stationary blade 41 of the outer peripheral surface of the turbine rotor 20, for example, a heat insulating piece 70 is provided. Here, the heat insulating piece 70 is supported by a portion facing the inner peripheral surface of the inner shroud 411 on the outer peripheral surface of the turbine rotor 20. The heat insulating piece 70 is provided to insulate heat between the turbine rotor 20 and a main flow path through which the working medium F flows inside the turbine casing 30.

The heat insulating piece 70 includes a heat insulating plate 71 and a leg part 72, and the heat insulating plate 71 and the leg part 72 are provided in sequence as going from the outside to the inside in the radial direction of the turbine rotor 20.

In the heat insulating piece 70, the heat insulating plate 71 includes a portion extending along the rotation center axis AX of the turbine rotor 20. The heat insulating plate 71 is installed to have a gap intervening between the outer peripheral surface of the heat insulating plate 71 and the inner peripheral surface of the inner shroud 411 and have a space intervening between the inner peripheral surface of the heat insulating plate 71 and the outer peripheral surface of the turbine rotor 20. The leg part 72 extends in the radial direction of the turbine rotor 20, and an engagement part 72*a* is formed inside in the radial direction in the leg part 72. The engagement part 72*a* is engaged with the turbine rotor 20.

In order to seal a clearance between the inner peripheral surface of the stationary blade 41 and the outer peripheral surface of the heat insulating plate 71, a seal fin 43 is provided as necessary. Further, in order to seal a clearance between the outer peripheral surface of the rotor blade 42 and the inner peripheral surface of the shroud segment 421 provided in the inner casing 31, the seal fin 43 is provided.

The axial flow turbine 12 includes an upstream-side gland part G1 and a downstream-side gland part G2.

The upstream-side gland part G1 is one end portion located on the upstream side Us of the working medium F of both end portions where the turbine stage 40 is not arranged in the axial direction in the axial flow turbine 12. The downstream-side gland part G2 is one end portion located on the downstream side Ds of the working medium F of both the end portions where the turbine stage 40 is not arranged in the axial direction in the axial flow turbine 12. In other words, a portion where the turbine stages 40 are arranged in the axial direction in the axial flow turbine 12 is sandwiched between the upstream-side gland part G1 and the downstream-side gland part G2.

In the upstream-side gland part G1 and the downstream-side gland part G2, gland sealing parts 35*a*, 35*b*, 35*c* are installed. The gland sealing parts 35*a*, 35*b*, 35*c* are provided to seal a clearance between a rotary body including the turbine rotor 20 and a stationary body including the turbine casing 30.

Specifically, a plurality of the gland sealing parts 35*a* are installed on the inner peripheral surface of the outer casing 32 in a manner to seal a clearance between the inner peripheral surface of the outer casing 32 and the outer peripheral surface of the turbine rotor 20 in the upstream-side gland part G1. A plurality of the gland sealing parts 35*b* are installed on the inner peripheral surface of the inner casing 31 in a manner to seal a clearance between the inner peripheral surface of the inner casing 31 and the outer peripheral surface of the turbine rotor 20 in the upstream-side gland part G1. Further, a plurality of the gland sealing parts 35*c* are installed on the inner peripheral surface of the packing head 321 in a manner to seal a clearance between the inner peripheral surface of the packing head 321 installed in the inner casing 31 and the outer peripheral surface of the turbine rotor 20 in the downstream-side gland part G2.

The gland sealing part 35*a*, 35*b*, 35*c* is configured to include, for example, a labyrinth fin. Other than that, the gland sealing part 35*a*, 35*b*, 35*c* may be composed of various seal structures such as a brush seal, a leaf seal, an abradable seal, and a honeycomb seal.

The transition piece 311 includes a portion extending in the radial direction in a manner to penetrate the outer casing 32 and the inner casing 31 from above the turbine casing 30. The transition piece 311 is coupled to the initial-stage turbine stage 40 so as to introduce the working medium F into the initial-stage turbine stage 40.

The cooling medium introduction pipe 313 extends, similarly to the transition piece 311, in the radial direction in a manner to penetrate the outer casing 32 and the inner casing 31 from above the turbine casing 30. The cooling medium introduction pipe 313 is installed in a manner to surround a portion extending in the radial direction in the transition piece 311. The inside diameter of the cooling medium introduction pipe 313 is larger than the outside diameter of the portion extending in the radial direction in the transition piece 311, and the cooling medium CF flows between the inner peripheral surface of the cooling medium introduction pipe 313 and the outer peripheral surface of the portion extending in the radial direction in the transition piece 311. The cooling medium CF having flowed between the cooling medium introduction pipe 313 and the transition piece 311 is introduced into a cooling chamber R31*a* formed in a manner to surround, in the rotation direction R, the turbine rotor 20 inside the inner casing 31.

In the inner casing 31, an inner casing cooling medium flow path H31 is formed through which the cooling medium CF flows. The inner casing cooling medium flow path H31 is provided to supply the cooling medium CF to the stationary blade 41 of the turbine stage 40. Here, the inner casing cooling medium flow path H31 includes a first inner casing cooling medium flow path part H311 and a second inner casing cooling medium flow path part H312.

The first inner casing cooling medium flow path part H311 is a hole along the axial direction of the turbine rotor 20. In this embodiment, the first inner casing cooling medium flow path part H311 has one end located on the upstream side Us of the working medium F, the one end being not communicated with the cooling chamber R31*a* unlike the case of the related art (see FIG. 7).

The second inner casing cooling medium flow path part H312 is a hole along the radial direction of the turbine rotor 20 and is formed on the side inner than the first inner casing cooling medium flow path part H311 in the radial direction. The second inner casing cooling medium flow path part H312 has one end located on the outside in the radial direction, the one end being communicated with the first inner casing cooling medium flow path part H311. In contrast to this, the other end inside in the radial direction of the second inner casing cooling medium flow path part H312 is communicated with the stationary blade 41 via the outer shroud 412.

The inner casing cooling medium flow path H31 is provided one each, for example, on the upper half side and the lower half side in the axial flow turbine 12. It is preferable that a plurality of the inner casing cooling medium flow paths H31 are provided at regular intervals in the rotation direction R.

In the turbine rotor 20, a rotor cooling flow path H21 is formed through which the cooling medium CF flows. The rotor cooling flow path H21 is configured so that the cooling medium CF flows from the cooling chamber R31*a* to a space located between the inner peripheral surface of the heat insulating plate 71 and the outer peripheral surface of the turbine rotor 20. Here, the rotor cooling flow path H21 includes a first rotor cooling flow path part H211, a second rotor cooling flow path part H212, and a third rotor cooling flow path part H213.

The first rotor cooling flow path part H211 is a hole along the radial direction of the turbine rotor 20. The first rotor cooling flow path part H211 has one end on the outside in the radial direction, the one end being communicated with the cooling chamber R31*a*. In contrast to this, the other end inside in the radial direction of the first rotor cooling flow path part H211 is communicated with the second rotor cooling flow path part H212.

The second rotor cooling flow path part H212 is a hole along the axial direction of the turbine rotor 20, and provided coaxially with the rotation center axis AX of the turbine rotor 20.

The third rotor cooling flow path part H213 is a hole along the radial direction of the turbine rotor 20. The third rotor cooling flow path part H213 has one end on the inside in the radial direction, the one end being communicated with the second rotor cooling flow path part H212. In contrast to this, the other end outside in the radial direction of the third rotor cooling flow path part H213 is communicated with a space located between the inner peripheral surface of the heat insulating plate 71 and the outer peripheral surface of the turbine rotor 20. The third rotor cooling flow path part H213 is provided to correspond to each of the plurality of turbine stages 40.

An extracted cooling medium pipe T1 includes, as illustrated in FIG. 1, a portion extending in the axial direction between the inner casing 31 and the outer casing 32, and has one end communicated with an extraction hole H81 and the other end communicated with an extracted medium supply hole H82.

The extraction hole H81 is formed in the inner casing 31 so that the cooling medium CF is extracted in the middle of flowing from the inside to the outside of the turbine casing 30 in the upstream-side gland part G1. Here, the extraction hole H81 extends in the radial direction, and the other end of the extraction hole H81 on the opposite side to one end thereof connected with the extracted cooling medium pipe T1 is communicated with a gap between the inner peripheral surface of the inner casing 31 and the outer peripheral surface of the turbine rotor 20 in the upstream-side gland part G1.

The extracted medium supply hole H82 extends in the radial direction, and the other end of the extracted medium supply hole H82 on the side opposite to one end thereof connected with the extracted cooling medium pipe T1 is communicated with the first inner casing cooling medium flow path part H311 of the inner casing cooling medium flow path H31.

[Flow of the Cooling Medium CF]

The flow of the cooling medium CF in the above axial flow turbine 12 will be explained. In FIG. 1, the cooling medium CF is illustrated by arrows of broken lines.

The cooling medium CF is introduced into the cooling chamber R31*a* provided inside the inner casing 31 via the clearance between the outer peripheral surface of the transition piece 311 and the inner peripheral surface of the cooling medium introduction pipe 313. Here, the cooling medium CF is introduced in a state where it is lower in temperature than the working medium F and higher in pressure than the working medium F.

The cooling medium CF introduced into the cooling chamber R31*a* leaks from the inside to the outside of the turbine casing 30 in the upstream-side gland part G1. Specifically, in the upstream-side gland part G1, the cooling medium CF flows from the cooling chamber R31*a* to the clearance between the inner peripheral surface of the inner casing 31 and the outer peripheral surface of the turbine rotor 20. In this embodiment, the cooling medium CF flowing from the cooling chamber R31*a* into the upstream-side gland part G1 includes the cooling medium CF flowing through the upstream-side gland part G1 from the cooling chamber R31*a* in the related art (see FIG. 7) and further includes the cooling medium CF flowing from the cooling chamber R31*a* directly into the inner casing cooling medium flow path H31. Thereafter, the cooling medium CF flows between the inner peripheral surface of the outer casing 32 and the outer peripheral surface of the turbine rotor 20 in the upstream-side gland part G1.

In this embodiment, in the upstream-side gland part G1, part of the cooling medium CF is extracted to the extraction hole H81 in the middle of flowing from the inside to the outside of the turbine casing 30. For example, in the upstream-side gland part G1, the part of the cooling medium CF is extracted from a position between the first gland sealing part 35*b* and the second gland sealing part 35*b* among the plurality of gland sealing parts 35*b* installed to seal the clearance between the inner casing 31 and the turbine rotor 20. The cooling medium CF extracted to the extraction hole H81 goes through the extracted cooling medium pipe T1 and the extracted medium supply hole H82 and flows to the inner casing cooling medium flow path H31. The cooling medium CF flowing into the inner casing cooling medium flow path H31 is introduced into the stationary blade 41 and the like as in the case of the related art.

Specifically, the cooling medium CF flowing into the inner casing cooling medium flow path H31 is introduced into a space provided in the outer shroud 412. The space provided in the outer shroud 412 is a space communicated in a ring shape in the rotation direction R, and communicated with, for example, a cooling hole (not illustrated) formed inside each of the stationary blade 41 and the inner shroud 411. The cooling medium CF flows from the outer shroud 412 into the cooling holes respectively formed in the stationary blade 41 and the inner shroud 411 in sequence. This cools the stationary blade 41 and the like. The cooling medium CF is then exhausted, for example, to the main flow path through which the working medium F flows inside the inner casing 31.

In addition to the above, in this embodiment, the cooling medium CF introduced into the cooling chamber R31*a* is introduced into the rotor cooling flow path H21 formed in the turbine rotor 20 and used for cooling the turbine rotor 20, the rotor blade 42 and the like as in the case of the related art.

[Operation/Effect]

The operation and effect of this embodiment will be explained.

In this embodiment, the one end, located on the upstream side Us of the working medium F, of the first inner casing cooling medium flow path part H311 constituting the inner casing cooling medium flow path H31, is not directly communicated with the cooling chamber R31*a* unlike the case of the related art. Therefore, the cooling medium CF is not directly introduced from the cooling chamber R31*a* into the inner casing cooling medium flow path H31 unlike the case of the related art. Into the inner casing cooling medium flow path H31, the cooling medium CF is introduced from the cooling chamber R31*a* via the extracted cooling medium pipe T1. Thus, in the axial flow turbine 12 in this embodiment, the cooling medium CF flows at a higher flow rate than that in the case of the related art, at the inlet portion into which the cooling medium CF flows in the upstream-side gland part G1. As a result of this, the inlet portion into which the cooling medium CF flows in the upstream-side gland part G1 is larger in pressure loss than that in the case of the related art. Accompanying this, the gland leakage amount of the cooling medium CF flowing from the inside to the outside of the turbine casing 30 can be reduced in the upstream-side gland part G1.

Accordingly, in this embodiment, the reduction in the gland leakage amount is easy and the turbine efficiency can be easily improved.

Note that the cross section of the extracted cooling medium pipe T1 is not illustrated but hatching is given to discriminate it from the other members in FIG. 1.

Modified Example 1-1

Modified Example 1-1 of the first embodiment will be explained using FIG. 2.

Figure 2:
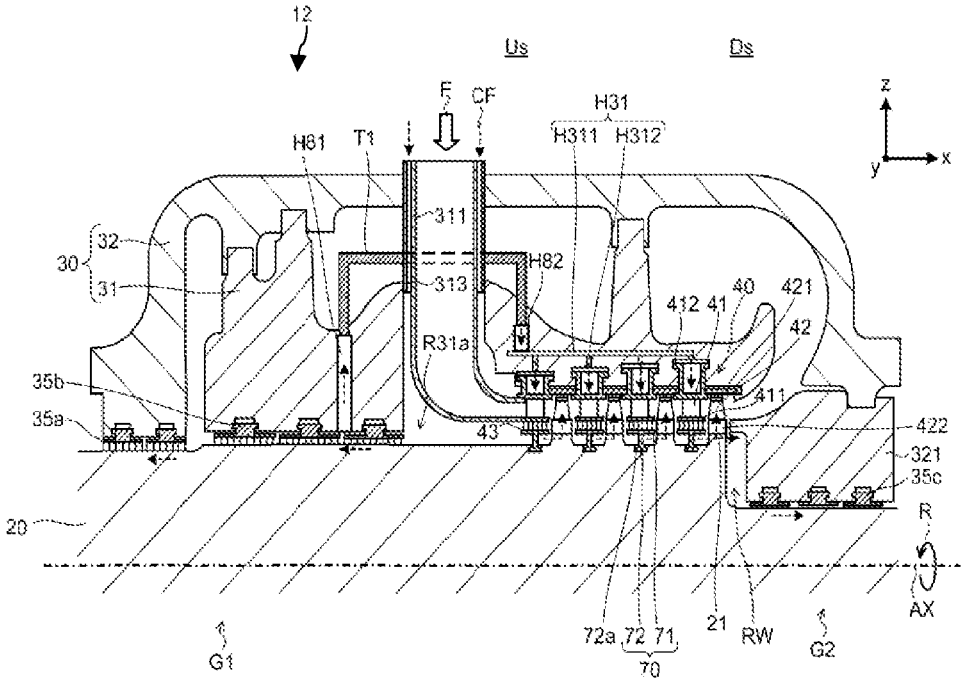
FIG. 2 is a cross-sectional view schematically illustrating a portion of a single flow type axial flow turbine according to Modified Example 1-1 of the first embodiment.

As illustrated in FIG. 2, the rotor cooling flow path H21 (see FIG. 1) does need to be provided. In the modified example of the first embodiment, the cooling medium CF is not introduced from the cooling chamber R31*a* into the rotor cooling flow path H21, and therefore the cooling medium CF corresponding to a portion to be introduced into the rotor cooling flow path H21 in the first embodiment is introduced into the inlet portion into which the cooling medium CF flows in the upstream-side gland part G1. As a result of this, the inlet portion into which the cooling medium CF flows in the upstream-side gland part G1 is larger in pressure loss than that in the case of the first embodiment. Accompanying this, the gland leakage amount of the cooling medium CF flowing from the inside to the outside of the turbine casing 30 can be further reduced in the upstream-side gland part G1. Note that in this case, the cooling medium CF passed through the stationary blade 41 and the like is made to be introduced into the rotor blade 42 and the like, and thereby can cool the rotor blade 42 and the like.

Modified Example 1-2

Modified Example 1-2 of the first embodiment will be explained using FIG. 3.

Figure 3:
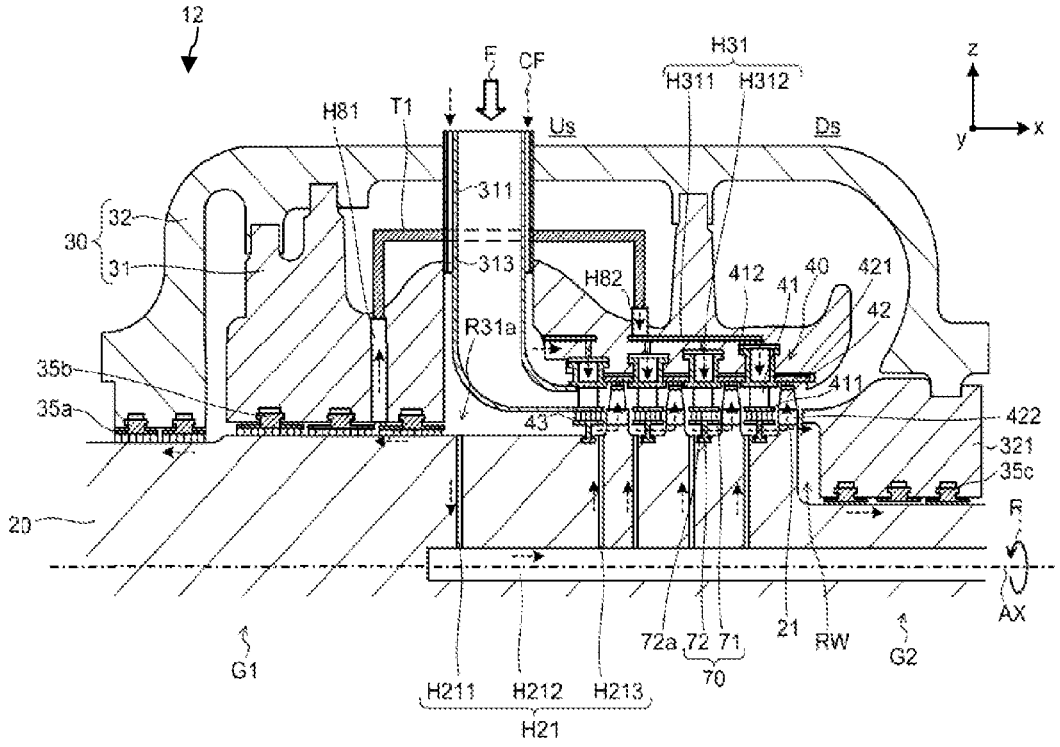
FIG. 3 is a cross-sectional view schematically illustrating a portion of a single flow type axial flow turbine according to Modified Example 1-2 of the first embodiment.

As illustrated in FIG. 3, the cooling medium CF extracted in the upstream-side gland part G1 may be made not to be introduced into the stationary blade 41 and the like constituting the initial-stage turbine stage 40 of the plurality of turbine stages 40 but to be introduced into the stationary blade 41 and the like of the turbine stage 40 located at a rear stage of the initial-stage turbine stage 40 (for example, a second or subsequent stage). In this case, the cooling medium CF not extracted in the upstream-side gland part G1 is introduced from the cooling chamber R31*a* into the stationary blade 41 and the like constituting the initial-stage turbine stage 40 of the plurality of turbine stages 40 as in the case of the related art.

In this modified example, the in-flow destination of the cooling medium CF flowing in other than the upstream-side gland part G1 of the cooling medium CF directly introduced from the cooling chamber R31*a* is only the initial stage. In other words, at the inlet portion into which the cooling medium CF flows in the upstream-side gland part G1, the cooling medium CF other than the cooling medium CF flowing into only the initial stage becomes larger in amount, also higher in flow rate, and larger in pressure loss in the upstream-side gland part G1, and thus becomes smaller in leakage amount.

On the other hand, in the case of the related art, the in-flow destination of the cooling medium CF flowing into other than the upstream-side gland part G1 of the cooling medium CF introduced into the cooling chamber R31*a* is all stages of the initial stage and second and subsequent stages via the first inner casing cooling medium flow path part H311, so that the cooling medium CF flowing into the cooling medium flowing into the upstream-side gland part G1 becomes smaller in amount than in this modified example, and thus becomes lower in flow rate and becomes larger in leakage amount in the upstream-side gland part G1.

Accordingly, the cooling medium CF flows at higher flow rate at the inlet portion of the upstream-side gland part G1 and becomes larger in pressure loss in the upstream-side gland part G1 in this modified example than in the related art, and therefore can be efficiently reduced in gland leakage amount. Further, when the pressure of the cooling medium CF extracted in the upstream-side gland part G1 is in a state of being lower than the pressure of the working medium F flowing through the initial-stage turbine stage 40, the cooling medium CF may be less likely to be exhausted from the stationary blade 41 and the like to the main flow path through which the working medium F flows. Thus, there is a possibility that the stationary blade 41 and the like of the initial-stage turbine stage 40 becoming highest in temperature cannot be sufficiently cooled. However, in this modified example, the cooling medium CF higher in pressure than the working medium F flowing through the initial-stage turbine stage 40 can be supplied and therefore can more sufficiently cool the initial-stage turbine stage 40 becoming highest in temperature.

Second Embodiment

A single flow type axial flow turbine 12*b* according to a second embodiment will be explained using FIG. 4.

Figure 4:
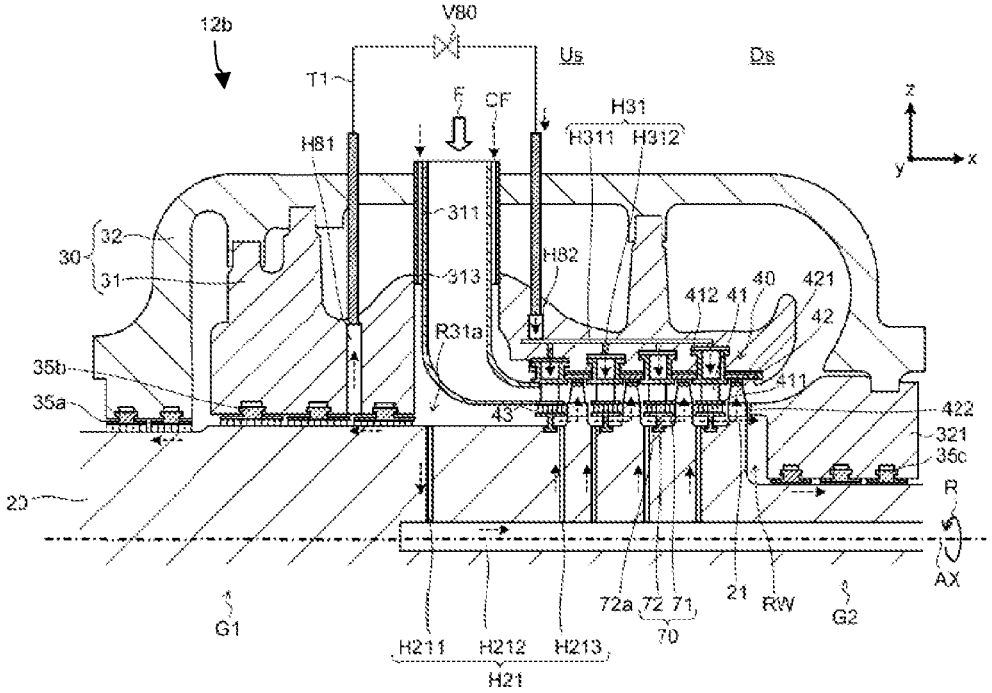
FIG. 4 is a cross-sectional view schematically illustrating a portion of a single flow type axial flow turbine according to a second embodiment.

As illustrated in FIG. 4, this embodiment is different from the case of the above first embodiment (see FIG. 1) in the form of the extracted cooling medium pipe T1. This embodiment is the same as the case of the first embodiment except for this point and related points. Therefore, explanation of the overlapped contents will be appropriately omitted.

In this embodiment, in the extracted cooling medium pipe T1, a flow rate regulating valve V80 is installed. A portion where the flow rate regulating valve V80 is installed in the extracted cooling medium pipe T1 is provided outside the turbine casing 30.

In this embodiment, the cooling medium CF extracted in the upstream-side gland part G1 is introduced into the stationary blade 41 and the like via the extracted cooling medium pipe T1. In this event, the flow rate of the cooling medium CF which has been extracted in the upstream-side gland part G1 and is to be introduced into the stationary blade 41 and the like can be regulated using the flow rate regulating valve V80 provided outside the turbine casing 30.

Accordingly, in this embodiment, the reduction of the gland leakage amount can be effectively realized and the turbine efficiency can be easily improved. Further, it becomes possible to confirm the measured temperatures of the stationary blade 41 and the rotor blade 42 and regulate the flow rate and thereby make a robust design in terms of strength, thus providing an aspect of improving the safety. The flow rate regulating valve V80 may be electrically or manually operated and can build a logic using the measured temperatures in the case of being electrically operated, so that even if the temperatures of the stationary blade and the rotor blade increase due to a sudden accident, it is possible to automatically cope with the sudden accident and can avoid a serious accident.

Third Embodiment

A single flow type axial flow turbine 12*c* according to a third embodiment will be explained using FIG. 5.

Figure 5:
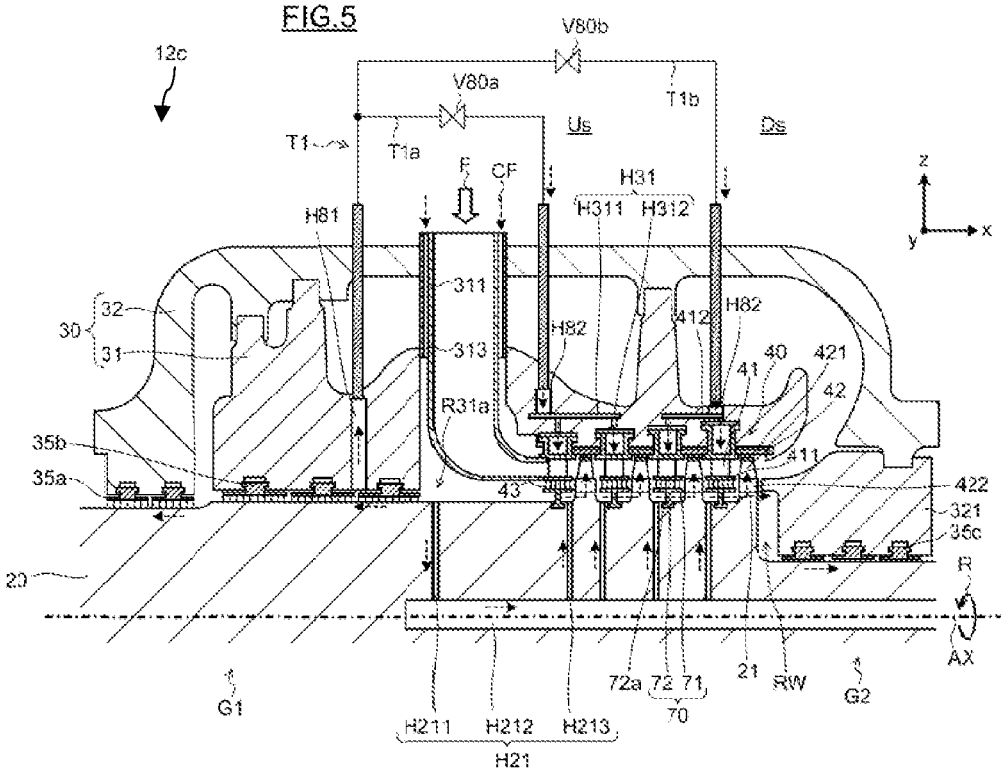
FIG. 5 is a cross-sectional view schematically illustrating a portion of a single flow type axial flow turbine according to a third embodiment.

As illustrated in FIG. 5, this embodiment is different from the case of the above second embodiment (see FIG. 4) in the form of the extracted cooling medium pipe T1. This embodiment is the same as the case of the first embodiment except for this point and related points. Therefore, explanation of the overlapped contents will be appropriately omitted.

In this embodiment, the extracted cooling medium pipe T1 includes a first extracted cooling medium pipe part T1*a* and a second extracted cooling medium pipe part T1*b*.

The first extracted cooling medium pipe part T1*a* is provided to introduce the cooling medium CF extracted in the upstream-side gland part G1, into the stationary blade 41 and the like constituting the turbine stage 40 located on the front stage side (upstream side Us) among the plurality of turbine stages 40.

The second extracted cooling medium pipe part T1*b* is provided to introduce the cooling medium CF extracted in the upstream-side gland part G1, into the stationary blade 41 and the like constituting the turbine stage 40 located on the rear stage side (downstream side Ds) of the turbine stage 40 located on the front stage side (upstream side Us) among the plurality of turbine stages 40.

In the first extracted cooling medium pipe part T1*a*, a first flow rate regulating valve V80*a* is installed. A portion where the first flow rate regulating valve V80*a* is installed in the first extracted cooling medium pipe part T1*a* is provided outside the turbine casing 30.

Similarly, in the second extracted cooling medium pipe part T1*b*, a second flow rate regulating valve V80*b* is installed. A portion where the second flow rate regulating valve V80*b* is installed in the second extracted cooling medium pipe part T1*b* is provided outside the turbine casing 30.

In this embodiment, the cooling medium CF extracted in the upstream-side gland part G1 flows branched to the first extracted cooling medium pipe part T1*a* and the second extracted cooling medium pipe part T1*b* in the extracted cooling medium pipe T1. The cooling medium CF which has passed through the first extracted cooling medium pipe part T1*a* is introduced into the stationary blade 41 and the like constituting the initial-stage and second-stage turbine stages 40 located on the front stage side. In this event, the cooling medium CF extracted in the upstream-side gland part G1 can be regulated in flow rate to be introduced into the stationary blade 41 and the like constituting the turbine stages located on the front stage side, using the first flow rate regulating valve V80*a* provided outside the turbine casing 30. Besides, the cooling medium CF which has passed through the second extracted cooling medium pipe part T1*b* is introduced, for example, into the stationary blade 41 and the like constituting the third-stage and fourth-stage turbine stages located on the rear stage side. In this event, the cooling medium CF extracted in the upstream-side gland part G1 can be regulated in flow rate to be introduced into the stationary blade 41 and the like constituting the turbine stages 40 located on the rear stage side, using the second flow rate regulating valve V80*b* provided outside the turbine casing 30.

In this embodiment, the cooling medium CF extracted in the upstream-side gland part G1 can be appropriately regulated according to the position of the turbine stage in the axial direction and introduced into the stationary blade 41 and the like. Accordingly, in this embodiment, it is possible to further effectively realize the reduction in gland leakage amount and easily improve the turbine efficiency,

Fourth Embodiment

A single flow type axial flow turbine 12*d* according to a fourth embodiment will be explained using FIG. 6.

Figure 6:
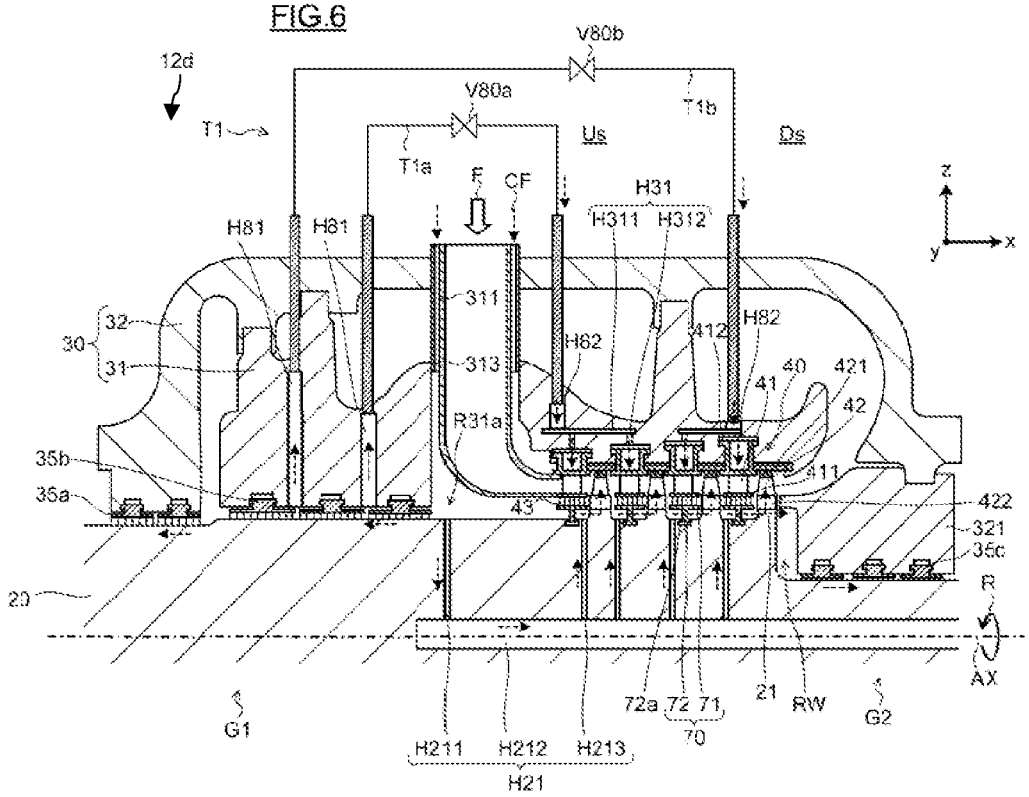
FIG. 6 is a cross-sectional view schematically illustrating a portion of a single flow type axial flow turbine according to a fourth embodiment.

As illustrated in FIG. 6, this embodiment is different from the case of the above third embodiment (see FIG. 5) in the forms of the first extracted cooling medium pipe part T1*a* and the second extracted cooling medium pipe part T1*b* in the extracted cooling medium pipe T1. This embodiment is the same as the case of the first embodiment except for this point and related points. Therefore, explanation of the overlapped contents will be appropriately omitted.

In the extracted cooling medium pipe T1 of this embodiment, the first extracted cooling medium pipe part T1*a* is configured to make the cooling medium CF flow which has been extracted at a first extraction position located between the first gland sealing part 35*b* and the second gland sealing part 35*b* of the plurality of gland sealing parts 35*b* installed to seal the clearance between the inner casing 31 and the turbine rotor 20 in the upstream-side gland part G1. The cooling medium CF which has passed through the first extracted cooling medium pipe part T1*a* is introduced into the stationary blade 41 and the like constituting the initial-stage and second-stage turbine stages 40 located on the front stage side. In this event, the cooling medium CF extracted in the upstream-side gland part G1 can be regulated in flow rate to be introduced into the stationary blade 41 and the like constituting the turbine stages 40 located on the front stage side, using the first flow rate regulating valve V80*a* provided outside the turbine casing 30.

In contrast to the above, the second extracted cooling medium pipe part T1*b* is configured to make the cooling medium CF flow which has been extracted at a second extraction position located between the second gland sealing part 35*b* and the third gland sealing part 35*b* of the plurality of gland sealing parts 35*b* installed to seal the clearance between the inner casing 31 and the turbine rotor 20 in the upstream-side gland part G1. In other words, the second extracted cooling medium pipe part T1*b* is configured to make the cooling medium CF flow which has been extracted at the second extraction position closer to the outside of the turbine casing than is the first extraction position in the upstream-side gland part G1. The cooling medium CF extracted at the second extraction position is lower in pressure than the cooling medium CF extracted at the first extraction position. The cooling medium CF which has passed through the second extracted cooling medium pipe part T1*b* is introduced into, for example, the stationary blade 41 and the like constituting the third-stage and fourth-stage turbine stages 40 located on the rear stage side. In this event, the cooling medium CF extracted in the upstream-side gland part G1 can be regulated in flow rate to be introduced into the stationary blade 41 and the like constituting the turbine stages 40 located on the rear stage side, using the second flow rate regulating valve V80*b* provided outside the turbine casing 30.

In this embodiment, the position where the cooling medium CF is extracted in the upstream-side gland part G1 is different according to the position of the turbine stage in the axial direction, and the cooling medium CF lower in temperature and higher in pressure can be introduced into the turbine stage 40 on the front stage side than that to the turbine stage 40 on the rear stage side. Accordingly, in this embodiment, it is possible to further effectively realize the reduction in gland leakage amount and easily improve the turbine efficiency.

<Others>

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

For example, the above embodiments explain the case of the $CO_2$ turbine but are not limited to this. Also in a turbine driven by a medium other than the working medium used in the $CO_2$ turbine, such as a steam turbine may be configured so that the cooling medium flows as in the above embodiments as needed.

REFERENCE SINGS LIST

12 . . . axial flow turbine, 12J . . . axial flow turbine, 12*b* . . . axial flow turbine, 12*c* . . . axial flow turbine, 12*d* . . . axial flow turbine, 20 . . . turbine rotor. 21 . . . rotor wheel, . . . turbine casing, 31 . . . inner casing, 32 . . . outer casing, 35*a* . . . gland sealing part, 35*b* gland sealing part, 35*c* . . . gland sealing part, 40 . . . turbine stage, 41 . . . stationary blade, 42 . . . rotor blade, 43 . . . seal fin, 70 . . . heat insulating piece, 71 . . . heat insulating plate, 72 . . . leg part, 72*a* . . . engagement part, 311 . . . transition piece, 313 . . . cooling medium introduction pipe, 321 . . . packing head, 411 . . . inner shroud, 412 . . . outer shroud, 421 . . . shroud segment, 422 . . . implanted part, AX . . . rotation center axis, CF . . . cooling medium, Ds . . . downstream side, F . . . working medium, G1 . . . upstream-side gland part, G2 . . . downstream-side gland part, H21 . . . rotor cooling flow path, H211 . . . first rotor cooling flow path part, H212 . . . second rotor cooling flow path part, H213 . . . third rotor cooling flow path part, H31 . . . inner casing cooling medium flow path, H311 . . . first inner casing cooling medium flow path part, H312 . . . second inner casing cooling medium flow path part, H81 . . . extraction hole, H82 . . . extracted medium supply hole, R . . . rotation direction, R31*a* . . . cooling chamber, R31*a* . . . cooling chamber, RW final-stage wheel space, T1 . . . extracted cooling medium pipe, T1*a* . . . first extracted cooling medium pipe part, T1*b* . . . second extracted cooling medium pipe part, Us . . . upstream side, V80 . . . flow rate regulating valve, V80*a* . . . flow rate regulating valve, V80*b* . . . flow rate regulating valve

What is claimed is:

1. A single flow type axial flow turbine including:

a turbine rotor;

a turbine casing housing the turbine rotor; and a turbine stage including a stationary blade cascade in which a plurality of stationary blades are arranged inside the turbine casing, and a rotor blade cascade in which a plurality of rotor blades are arranged on the turbine rotor inside the turbine casing, in which the turbine casing is structured to allow a working medium to be introduced into the turbine casing and to flow in an axial direction of the turbine rotor to rotate the turbine rotor, the turbine casing is further structured to allow a cooling medium lower in temperature and higher in pressure than the working medium to be introduced to the inside of the turbine casing, the single flow axial flow turbine comprising:

a cooling chamber, configured to allow the cooling medium to be introduced therein, being formed inside the turbine casing and being located on an upstream side of the turbine stage in the axial direction, an upstream-side gland part being provided in the turbine casing and being located on an upstream side of the cooling chamber in the axial direction, the upstream-side gland part having an inner peripheral surface, on which an upstream-side gland sealing part is provided, the upstream-side gland sealing part sealing a clearance between the turbine rotor and the upstream-side gland part, an extraction hole formed in the upstream-side gland part, the extraction hole configured to extract cooling medium from a space between the cooling chamber and the outside of the turbine casing, a cooling medium flow path formed in the turbine casing and connected to the stationary blades, the cooling medium flow path structured to provide the extracted cooling medium to the stationary blades, and an extracted cooling medium pipe having one end communicating with the extraction hole and the other end communicating with the cooling medium flow path, wherein the cooling medium flow path is not directly communicated with the cooling chamber, and wherein the extracted cooling medium pipe and the cooling medium flow path are structured such that the extracted cooling medium is introduced into the stationary blades via the extracted cooling medium pipe and the cooling medium flow path.

2. The axial flow turbine according to claim 1, wherein:

the turbine casing comprises:

an inner casing in which the stationary blade cascade is arranged; and an outer casing which houses the inner casing therein;

the extracted cooling medium pipe is provided between the inner casing and the outer casing.

3. The axial flow turbine according to claim 1, further comprising a flow rate regulating valve installed in the extracted cooling medium pipe, wherein:

the flow rate regulating valve is provided outside the turbine casing.

4. The axial flow turbine according to claim 3, wherein:

the turbine stage comprises a plurality of turbine stages, the plurality of turbine stages being arranged in an axial direction along a rotation axis of the turbine rotor; and the extracted cooling medium pipe comprises:

a first extracted cooling medium pipe part configured to introduce the cooling medium extracted in the upstream-side gland part into the stationary blade constituting the turbine stage located on a front stage side among the plurality of turbine stages; and a second extracted cooling medium pipe part configured to introduce the cooling medium extracted in the upstream-side gland part into the stationary blade constituting the turbine stage located on a rear stage side of the turbine stage located on the front stage side among the plurality of turbine stages.

5. The axial flow turbine according to claim 4, wherein:

the first extracted cooling medium pipe part is configured such that the cooling medium extracted at a first extraction position in the upstream-side gland part flows; and the second extracted cooling medium pipe part is configured such that the cooling medium extracted at a second extraction position closer to the outside of the turbine casing than the first extraction position in the upstream-side gland part flows.

* * * * *